US006119704A

United States Patent [19]

Bouchat et al.

[11] Patent Number: 6,119,704

[45] **Date of Patent: *Sep. 19, 2000**

[54] DISPOSABLE DIE-CUT COSMETIC SAMPLE APPLICATORS

[75] Inventors: Henry Bouchat, Baltimore; Catholyn T. Griffiths; Anthony J. Gunderman, both of Phoenix, all of Md.

[73] Assignee: Color Prelude, Inc., Baltimore, Md.

[ * ] Notice: This patent is subject to a terminal disclaimer.

[21] Appl. No.: 09/198,261

[22] Filed: Nov. 24, 1998

[51] Int. Cl.[7] ..... A45D 40/30; A45D 40/26

[52] U.S. Cl. ..... 132/320; 132/319; 206/823

[58] Field of Search ..... 132/320, 316, 132/294, 317, 318, 319, 333, 293; 206/823, 581, 572

[56] References Cited

U.S. PATENT DOCUMENTS

| | | | |
|---|---|---|---|
| 1,836,833 | 12/1931 | Ames | 132/318 |
| 2,061,139 | 11/1936 | Cohen | 132/314 |
| 2,561,400 | 7/1951 | Morrell | 132/320 |
| 2,775,249 | 12/1956 | Morrell | 132/318 |
| 2,998,821 | 9/1961 | Hurdel | 132/318 |
| 3,860,016 | 1/1975 | Mackiernan | 132/88 |
| 4,372,098 | 2/1983 | Mason | 53/412 |
| 4,747,782 | 5/1988 | Campbell, Jr. | 434/377 |
| 4,890,872 | 1/1990 | Parrotta et al. | 132/320 |
| 4,995,408 | 2/1991 | Wallschlaeger | 132/320 |
| 5,031,647 | 7/1991 | Seidler | 132/320 |
| 5,105,941 | 4/1992 | Dolan et al. | 132/314 |
| 5,301,697 | 4/1994 | Gueret | 132/298 |
| 5,348,031 | 9/1994 | Cloud | 132/317 |
| 5,478,308 | 12/1995 | Cartmell et al. | 602/57 |
| 5,562,112 | 10/1996 | Gunderman et al. | 132/333 |
| 5,647,941 | 7/1997 | Gunderman et al. | 156/277 |
| 5,690,130 | 11/1997 | Gunderman et al. | 132/318 |
| 5,738,382 | 4/1998 | Grosskopf et al. | 283/81 |
| 5,799,675 | 9/1998 | Gunderman et al. | 132/320 |
| 5,863,628 | 1/1999 | Barry | 428/40.1 |
| 5,975,582 | 11/1999 | Treleaven | 283/81 |

*Primary Examiner*—John J. Wilson
*Assistant Examiner*—Robyn Kieu Doan
*Attorney, Agent, or Firm*—Ostrolenk, Faber, Gerb & Soffen, LLP

[57] ABSTRACT

An applicator unit providing a plurality of disposable die cut applicators is made by adhering an applicator material to a backing substrate and die cutting the desired applicator shapes. A protective film is then adhered to the die cut applicator piece to protect the applicators from soilage or contamination. The applicator unit can easily be inserted into magazines, brochures, etc., along with a cosmetic sampler or a plurality of cosmetic samplers without adding substantial bulk to the carrier medium. In this manner, one applicator unit permits a consumer to sample from a plurality of cosmetic samplers and also to apply multiple applications of a cosmetic from a cosmetic sampler.

25 Claims, 1 Drawing Sheet

DISPOSABLE DIE-CUT COSMETIC SAMPLE APPLICATORS

BACKGROUND OF THE INVENTION

1. Field of the Invention

The present invention relates to die-cut applicators for use with cosmetic samplers.

2. Description of the Related Art

Cosmetics have typically been available for sampling in department stores in the very containers in which the product is sold, or in smaller versions of the same container. This method generally works well with fragrances, where the product is applied by spraying onto the skin of the consumer such that the product reservoir remains untouched. Such method is less effective in marketing cosmetics, however, because many consumers feel uneasy about sampling a product from a container from which others have previously sampled due to the fear of contracting disease or infection.

To resolve the issue presented above, various cosmetic sampler packages have been developed which provide a more inexpensive and convenient means of marketing cosmetics by hand-outs or by mail, e.g., as inserts in department store bills or magazines. For example, U.S. Pat. No. 4,751,934 to Moir et al., assigned to the assignee of the present invention, provides a cosmetic sampler in which the cosmetic sample is screen printed onto a base substrate and is covered with a cover layer. The sampler is flat enough to enable distribution with fliers or in magazines, and may be provided in unit packages or in a strip of sampler packages.

Similarly, U.S. Pat. No. 5,072,831 to Parrotta et al. provides a compact advertising sampler which can be inserted in magazines and catalogues.

When the product to be sampled normally requires an applicator, such as a powder-based cosmetic, the consumer often has to resort to using her fingers to apply the sample, as is the case with the samplers discussed above. The drawback, of course, is that the application process is messy; moreover, it is difficult to achieve an even coverage of the product using one's fingers.

The problems described above also arise in the distribution of samples of creams, lipsticks, fragrances, pharmaceuticals, lotions, and other types of high viscosity, waxy materials.

On the other hand, sampler packages with applicators provided therewith have also been proposed in the art. Generally, such sampler plus applicator type packages are provided in one of two forms.

In the first of these types of samplers, the applicator is the primary element of the package and the cosmetic to be sampled is disposed directly on the applicator. The idea behind this type of sampler is that the consumer can immediately apply the cosmetic sample upon opening the package without having to "dip" into the cosmetic with her fingers or having to provide her own applicator. U.S. Pat. No. 4,661,388 to Charbonneau is one example of this type of applicator sampler.

Charbonneau discloses a pad of applicator sheets having microcapsules of the cosmetic sample dispersed therein. The problem presented by "pre-applying" the cosmetic sample to the applicator, however, is that application of the cosmetic is difficult to control by the consumer. Specifically, if the applicator is thoroughly coated or saturated with the cosmetic, then application of the cosmetic would result in too much of the cosmetic being applied in one location. Furthermore, even coverage of the cosmetic would be difficult to obtain since the supply of cosmetic would deplete rapidly upon application using one area of the applicator, resulting in the necessity of continually having to shift the applicator around to complete the application. In short, this type of sampler package requires an application process which is inconvenient to the consumer.

A second type of applicator sampler package known in the art is exemplified in U.S. Pat. No. 5,031,647 to Seidler. Seidler discloses a sampler applicator in which the cosmetic sample is provided in a well shaped reservoir on a foldable elongated substrate, while the applicator portion includes a substrate extending from and symmetrical to the substrate of the well portion such that the applicator area matingly fits into the well. In this manner, the applicator also serves as a cover for the cosmetic sample. Due to the depth of the walls forming the well and the matchingly sized applicator head, however, it is difficult to obtain a sufficient amount of the sample on the applicator for a full application, especially as the cosmetic supply becomes substantially depleted. This problem is compounded by the structure of the sampler in which the applicator portion is physically attached to the well portion, thus further limiting the maneuverability of the applicator. Moreover, this type of sampler package is bulky and is unsuitable for mass distribution means, i.e., it cannot easily be inserted into mail fliers, magazines, or catalogues.

It is additionally noted that the sampler applicators in the prior art are generally made of foam or sponge which is too bulky to be used in advertising inserts, or a puff of material or fiber, with which it is difficult to obtain even coverage of the cosmetic.

SUMMARY OF THE INVENTION

The present invention addresses the shortcomings in the art discussed above, inter alia, by providing a sampler unit having die-cut thereon a plurality of disposable applicators. The applicators include an applicator material applied over one entire surface of the backing substrate, whereupon the covered substrate is die cut to form a plurality of unit applicator shapes. The applicator material may be a woven or non-woven fiber or a thin foam and may be applied by extrusion or adhesion lamination or electrostatic assist as appropriate for the material. The die-cut piece is then covered with a clear film, which is attached thereto by an adhesive.

The applicator unit can easily be inserted into magazines, brochures, etc., along with a cosmetic sampler or plurality thereof without adding substantial bulk to the carrier medium. Additionally, one applicator unit permits a user to sample from a plurality of cosmetic samplers and also to apply multiple applications of one cosmetic from a cosmetic sampler.

Other features and advantages of the present invention will become apparent from the following description of the invention which refers to the accompanying drawings.

DETAILED DESCRIPTION OF THE PREFERRED EMBODIMENT

Figure 1:
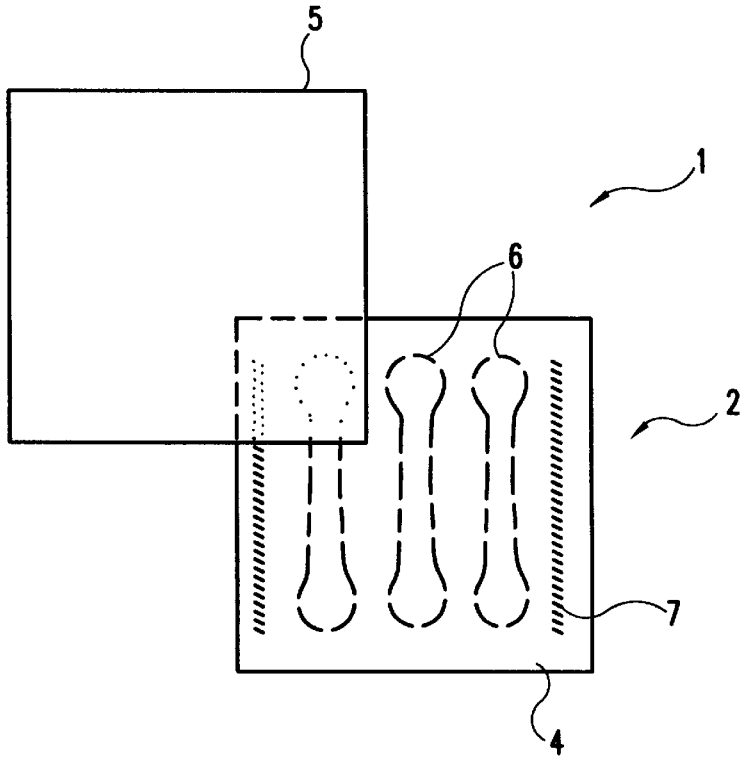
FIG. 1 shows an exploded top view of a preferred embodiment of the present invention.
Figure 2:
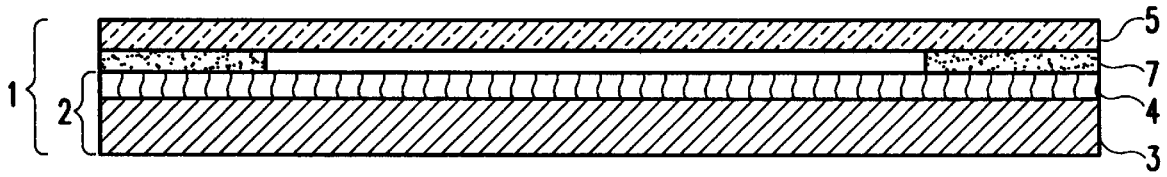
FIG. 2 shows a side view of a preferred embodiment of the present invention.

FIGS. 1 and 2 show an example embodiment of an applicator unit 1 of the present invention which comprises a backing substrate 3 with an applicator material 4 covering a top surface thereof. A plurality of die cut applicator shapes 6 are formed in the substrate having applicator material applied thereon. Additionally, a transparent or translucent protective film 5 is adhered over the applicator side of the covered substrate to protect the applicator material 4 from soilage or contamination prior to use. The applicator unit 1 may be assembled as described in greater detail below.

Substrate 3 may be comprised of board, paper, or plastic, and may be coated on a bottom side thereof with a polymer film such as polypropylene, polyethylene, polyester, high impact polystyrene, or derivatives thereof. As mentioned above, substrate 3 includes an applicator material 4 preferably covering an entire surface of substrate 3. It is also possible to apply the applicator material to only the portion of the substrate which will form the die cut applicators 6 as explained below. Applicator material 4 may optionally be applied in an embossed/debossed pattern, or the embossed/debossed pattern may also optionally be provided to the applicator material surface after application to the substrate surface.

According to one embodiment of the present invention, the applicator material 4 is applied to the surface of backing substrate 3 by first printing or coating an adhesive on one surface of the backing substrate. The applicator material may then be attached to backing substrate 3 by adhesive lamination. Alternative methods for applying the applicator material to backing substrate 3 include heat sealing the material to the substrate, or forming the applicator material using extrusion lamination and then adhering the material to backing substrate 3. In each of these methods, a woven fiber, a non-woven fiber, a reticulated foam, or a non-reticulated foam may be used as the applicator material.

In yet another alternative, fibers such as cotton, nylon, acrylic, polypropylene, polyester, rayon, cellulose, or derivitives and/or combinations thereof, are introduced into a chamber and, by electrostatic assist, the fibers are flocked onto the substrate after the placement of the adhesive on backing substrate 3. In this manner, the fabric fibers or non-woven material can be applied to cover one entire surface of the substrate or in chosen portions to form the applicator surface of applicator piece 2.

Once the applicator material 4 is applied to the backing substrate 3, the applicator piece 2 is then die cut to form a plurality of the desired applicator shapes 6. Preferably, three applicator shapes 6 are die cut into the applicator piece 2, although more or less may be cut in accordance with the preferences of the distributer. In the preferred embodiment, the shapes of the die cut applicators on the applicator piece 2 are identical. Alternatively, however, the applicator shapes may have different shapes and/or may be of different sizes.

Next, perimeter adhesive 7 is printed along at least one edge, and preferably along two opposing edges, of the applicator piece 2 or protective film 5. The applicator piece 2 and the protective film 5 are then adhered together, such as by lamination, with the applicator side 4 facing the film to form the assembled applicator unit 1. Alternatively, protective film 5 may be heat sealed to the applicator piece 2.

Protective film 5 should entirely cover at least the applicator material on the die cut applicator shapes, and preferably covers the entire covered substrate. Adhesive 7 is preferably, but not necessarily, pressure sensitive. Other forms of adhesives which are consistent with the present invention include anaerobic, self crosslinking, U.V. curable, or heat curable adhesives, or the adhesive material can simply be dried by evaporation.

Protective film 5 may be any type of flexible plastic sheet or thermoformable film having a thickness of 0.5–15.0 mils, such as amorphous polyester, co-polyester, PVC, PET, polycarbonate, polystyrene, polyethylene, polypropylene, or derivatives thereof, but is preferably formed of a polyester resin film such as "MYLAR"™. Optionally, cover film 5 may include copy print printed on the exterior surface thereof for product labeling, advertisement, providing directions for application, etc. Such print may also be reverse printed onto the surface of cover film 5 facing the applicator material. Preferably, cover film 5 is transparent, but alternatively may be translucent or opaque and having print thereon as described. Alternatively, the applicator unit may be provided without a protective cover film, if soiling or contamination of the applicator material is not of concern.

The applicator unit as disclosed herein with reference to the preferred embodiment thereof provides a plurality of disposable applicators suitable for mass distribution and provides flexibility in the combination of cosmetic samplers which can be distributed with the applicator card of the present invention. By providing the applicator unit of the present invention along with a cosmetic sampler or a plurality thereof, a consumer would be able to conveniently apply multiple applications of the cosmetic sample or to sample a variety of cosmetics from the plurality of cosmetic samplers where no applicators or insufficient "extras" are otherwise provided.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An applicator unit for use with cosmetic samplers, comprising:

a backing substrate;

an applicator material covering at least a portion of one surface of the substrate; and a plurality of disposable applicators formed in the covered substrate by die cutting, wherein the disposable applicators are readily separable from a remainder of the substrate, the applicator material on the applicators being usable to apply a cosmetic product.

2. The applicator unit according to claim 1, wherein the applicator material comprises a material selected from the group consisting of cotton, nylon, cellulose, acrylic, rayon, polyester, polypropylene, reticulated foam, non-reticulated foam, and derivitives thereof.

3. The applicator unit according to claim 1, wherein the applicator material is provided in a continuous layer across the entire surface of the backing substrate.

4. The applicator unit according to claim 1, wherein the applicator material is provided in an embossed and/or debossed pattern on the backing substrate.

5. The applicator unit according to claim 1, wherein the backing substrate comprises a material selected from board, paper, and plastic.

6. The applicator unit according to claim 1, further comprising a protective cover film covering the applicator material.

7. The applicator unit according to claim 6, wherein the cover film is transparent.

8. The applicator unit according to claim 6, wherein the cover film comprises a material selected from a flexible plastic sheet and a thermoformable film, wherein the thermoformable film is selected from amorphous polyester, co-polyester, polycarbonate, PVC, PET, polyethylene, polypropylene, polystyrene, and derivatives thereof.

9. A method for making an applicator unit comprising the steps of:

(a) providing a backing substrate;

(b) applying an applicator material to at least a portion of a surface of the backing substrate to form an applicator piece; and (c) die cutting the applicator piece to form a plurality of disposable applicators after applying the applicator material to the backing substrate, the applicator material on the disposable applicators being usable to apply a cosmetic product.

10. The method of making an applicator unit according to claim 9, wherein the applicator material is applied in a continuous layer across the entire surface of the backing substrate.

11. The method of making an applicator unit according to claim 9, wherein the applicator material is formed from a material selected from cotton, nylon, rayon, acrylic, cellulose, polypropylene, polyester, a non-woven fabric, a reticulated foam, a nonreticulated foam, and derivatives thereof.

12. The method of making an applicator unit according to claim 9, wherein the step of applying the applicator material to the backing substrate includes the step of applying an adhesive onto the substrate.

13. The method of making an applicator unit according to claim 12, wherein the adhesive is printed onto the substrate.

14. The method of making an applicator unit according to claim 12, wherein the adhesive is coated onto the substrate.

15. The method of making an applicator unit according to claim 12, wherein the step of applying the applicator material to the backing substrate further includes the step of adhesively laminating a non-woven material to the substrate.

16. The method of making an applicator unit according to claim 12, wherein the step of applying the applicator material to the backing substrate further includes the step of flocking fabric fibers onto the backing substrate via electrostatic assist.

17. The method of making an applicator unit according to claim 9, wherein the step of applying the applicator material to the backing substrate includes the step of extrusion laminating a non-woven material to the substrate.

18. The method of making an applicator unit according to claim 9, wherein the step of applying the applicator material to the backing substrate includes the step of heat sealing a non-woven material to the substrate.

19. The method of making an applicator unit according to claim 9, wherein the applicator material is applied in an embossed and/or debossed pattern onto the backing substrate.

20. The method of making an applicator unit according to claim 9, further comprising the step of covering the applicator material on the die cut disposeable applicators with a protective film.

21. The method of making an applicator unit according to claim 20, further comprising the step of heat sealing the protective film to the applicator piece.

22. The method of making an applicator unit according to claim 20, further comprising the step of applying an adhesive on at least one edge of the surface of the die cut applicator piece having the applicator material to adhere the protective film thereto.

23. The method of making an applicator unit according to claim 22, wherein the protective film is laminated to the applicator piece to cover the applicator piece.

24. The method of making an applicator unit according to claim 20, further comprising the step of applying an adhesive on at least one edge of the protective film to adhere the die cut applicator piece thereto.

25. The method of making an applicator unit according to claim 24, wherein the applicator material on the applicator piece is laminated to the protective film.

* * * * *